US008635812B2

(12) United States Patent
Sawada et al.

(10) Patent No.: US 8,635,812 B2
(45) Date of Patent: Jan. 28, 2014

(54) THROATING

(75) Inventors: Yohei Sawada, Nagoya (JP); Yoshinori Hibino, Ama-gun (JP)

(73) Assignee: Nichiha Corporation, Nagoya-Shi (JP)

( * ) Notice: Subject to any disclaimer, the term of this patent is extended or adjusted under 35 U.S.C. 154(b) by 401 days.

(21) Appl. No.: 12/929,579

(22) Filed: Feb. 2, 2011

(65) Prior Publication Data

US 2011/0192095 A1 Aug. 11, 2011

(30) Foreign Application Priority Data

Feb. 9, 2010 (JP) ..... 2010-026788

(51) Int. Cl.
*E04F 19/00* (2006.01)

(52) U.S. Cl.
CPC ..... *E04F 19/00* (2013.01)
USPC ..... 52/62; 52/58; 52/97; 52/716.2

(58) Field of Classification Search
USPC ..... 52/58–62, 97, 309.3, 309.5, 198, 199, 52/716.1–717.06; 428/41.7
See application file for complete search history.

(56) References Cited

U.S. PATENT DOCUMENTS

| | | | | | |
|---|---|---|---|---|---|
| 2,721,819 | A | * | 10/1955 | Munro | 52/58 |
| 2,768,475 | A | * | 10/1956 | Seelen et al. | 52/717.02 |
| 4,655,009 | A | * | 4/1987 | DeGraan | 52/58 |
| 7,368,155 | B2 | * | 5/2008 | Larson et al. | 428/40.1 |
| 7,588,813 | B2 | * | 9/2009 | Iwasaki et al. | 428/41.7 |

FOREIGN PATENT DOCUMENTS

| | | | |
|---|---|---|---|
| JP | 3031123 | U | 11/1996 |
| JP | 2002-121871 | A | 4/2002 |
| JP | 2003-96931 | A | 4/2003 |
| JP | 2004-300873 | A | 10/2004 |

* cited by examiner

*Primary Examiner* — Mark Wendell
*Assistant Examiner* — Matthew J Smith
(74) *Attorney, Agent, or Firm* — Birch, Stewart, Kolasch & Birch, LLP

(57) ABSTRACT

The present invention provides a throating that enables temporary affixing and facilitates construction work.

The throating of the present invention includes a rear plate part that is fixed to a building frame, a throating plate part bent obliquely downward and frontward at a lower end of the rear plate part, and a front plate part bent downward from a front end of the throating plate part. The throating has an adhesive layer on each of a front face and a rear face of the rear plate part, and has a release paper on the surface of the adhesive layers. A top end portion of the rear plate part is covered by an adhesive layer and/or release paper. Preferably, the release paper has a cutting line.

13 Claims, 12 Drawing Sheets

THROATING

BACKGROUND OF THE INVENTION

1. Field of the Invention

The present invention relates to a throating that is fitted to a building and that drains, in a frontward direction, rainwater flowing down the surface of a siding member.

2. Description of the Related Art

Conventional throatings, which are manufactured through cutting and folding of a metal sheet, have an elongate shape in the horizontal direction, and are disposed, for instance, on foundation sills of buildings, or between siding boards that are disposed above and below, with a view to prevent rainwater, which flows down the outer wall of the building, from intruding into the building.

For instance, Japanese Utility Model Registration No. 3031123 discloses a throating that comprises amount wall part fixed byway of nails or the like, an obliquely protruding wall part bent obliquely downward and frontward from the lower end of the mount wall part, and a protruding end wall part bent downward from the front end of the obliquely protruding wall part. Japanese Utility Model Registration No. 3031123 discloses also the feature of fixing the mount wall part to a foundation sill of the building, using nails, to fix thereby the throating to the foundation sill of the building. As a result, rainwater flowing down the outer face of the outer wall is led so as to drip outward.

Japanese Patent Application Publication No. 2003-96931 discloses a throating provided with a mounting part formed out of a thin plate-like PVC steel sheet bent to a Z cross-sectional shape, and a throating part formed at the lower end of the mounting part . The throating part comprises: an extension part which is disposed at the lower end of the mounting part downward toward the front face top end portion of an exterior material so as to slant from the rear face toward the front face of the exterior material, and which covers the top end face of the exterior material; another extension part which extends downward from the leading end of the aforementioned extension part, along the front face of the exterior material, and which covers the front face top end portion of the exterior material; and a protrusion that protrudes upward, from the leading end of the other extension part, toward the rear face of the exterior material. Japanese Patent Application Publication No. 2003-96931 discloses the features of inserting the mounting part between an upper exterior material and a lower exterior material and fixing the mounting part by driving a fastening member such as a screw thereinto, so that the throating prevents water such as rainwater from intruding into the rear faces of the upper exterior material and the lower exterior material.

Further, Japanese Patent Application Publication No. 2002-121871 discloses a throating that is constituted by a mounting part composed of one sheet of an elongate surface material, and mounted to an outer wall; an inclined face that is bent from the mounting part, and an exposed face that is further bent from the inclined face. The throating is disposed at a lean-to roof connecting section by way of which the outer wall and a lean-to roof are connected, so that the throating waterproofs thereby the lean-to roof connecting section.

Thus, the throating may be built on a foundation sill of a building, or between siding boards disposed above and below the throating, or at a lean-to roof connecting section by way of which an outer wall and a lean-to roof are connected. As a result, the throating drains, in a frontward direction, rainwater flowing down the surface of a siding member.

In all such construction structures, the throating is fixed to a building frame. Also, a moisture-permeable waterproof sheet is disposed between the siding boards and the building frame. The building frame is rendered waterproof as a result. The moisture-permeable waterproof sheet is disposed so as cover part of the surface of the throating that is fixed to the building frame. Ordinarily, the lower end of the moisture-permeable waterproof sheet is affixed to the throating using adhesive tape. In order to prevent flapping of the moisture-permeable waterproof sheet on account of wind, and to prevent intrusion of rainwater from below due to blow-back or the like, the adhesive tape is affixed spanning the entire longitudinal direction of the throating, so as to close the lower end of the moisture-permeable waterproof sheet.

Affixing of the adhesive tape to the throating is therefore a cumbersome operation.

Such being the case, Japanese Patent Application Publication No. 2004-300873 discloses a throating to which an adhesive tape, such as a two-sided adhesive tape, is affixed beforehand, at a front face of a mounting part that constitutes a fixing base of the throating.

The throating of Japanese Patent Application Publication No. 2004-300873 facilitates work since the adhesive tape is affixed beforehand to the front face of the mounting part.

However, as described above, throatings are elongate in the horizontal direction, being ordinarily about 3 m long. The throating is normally fixed to the building frame using nails. It is thus difficult and cumbersome, for a single operator alone, to accomplish the necessary nail driving while keeping the throating level horizontally level. In a case where, after fixing, the fixing position of the throating is to be corrected upon noticing that the throating slants slightly, it becomes necessary to pull the nails out, correct the position of throating, and drive the nails again, all of which is cumbersome.

Moreover, throatings are manufactured through cutting and bending of a metal sheet, and hence may injure personnel or damage other materials with the cut metal sheet during transport and construction.

SUMMARY OF THE INVENTION

The present invention provides a throating that enables temporary affixing and facilitates construction work.

The present invention provides a throating having a rear plate part that is fixed to a building frame, a throating plate part bent obliquely downward and frontward at a lower end of the rear plate part, and a front plate part bent downward from a front end of the throating plate part, wherein the throating has an adhesive layer on each of a front face and a rear face of the rear plate part, and has a release paper on the surface of the adhesive layers. The adhesive layers have the release paper on the surface thereof. Hence, bonding between throatings can be prevented, while preserving the adhesive performance of the adhesive layer during storage and transport. Moreover, since an adhesive layer is provided on the rear face of the rear plate part, the throating can be temporarily of to a building frame by peeling off the release paper. Further, an adhesive layer is provided also on the front face of the rear plate part, and hence a moisture-permeable waterproof sheet can be fixed to the throating by peeling the release paper during the construction work. There are two different configurations in which an adhesive layer is formed also on the top end portion of the rear plate part, and in which an adhesive layer is formed only on the front face and the rear face of the rear plate part. Configurations in which an adhesive layer is also formed on the top end portion of the rear plate part include a configuration in which the adhesive layers on the front face, the rear face and the top end portion of the rear plate part are connected to each other, a configuration in which adhesive layers are provided on the front face and the rear face of the rear plate part, such that the adhesive layers are not connected to an adhesive layer on the top end portion, and a configuration in which an adhesive layer is provided on the front face or the rear face of the rear plate part, such that the adhesive layer is not connected to an adhesive layer on the top end portion. In a case where an adhesive layer is provided only on the front face and the rear face of the rear plate part, the release papers on the front face and the rear face are connected, and cover the top end portion of the rear plate part. As a result, the top end portion of the rear plate part is constantly covered by release paper. This allows preventing the top end portion from damaging other materials, or from injuring personnel, during transport and construction.

Preferably, the release paper has a cutting line extending in the lengthwise direction of the rear plate part.

More preferably, the cutting line is provided at a portion covering the top end portion of the rear plate part, or at a portion where the release paper covers the front face of the rear plate part, or at a portion where the release paper covers the rear face of the rear plate part. As a result, this allows peeling just the release paper that covers the adhesive layer on the rear face of the rear plate part, and hence the throating can be temporarily affixed while the adhesive layer on the front face of the rear plate part remains covered by release paper, resulting in facilitating construction work.

The throating is manufactured through bending, or extrusion, of a metal sheet such as Galvalume steel sheet, Galtite steel sheet, aluminum steel sheet, stainless steel sheet, alloy-plated steel sheet, galvanized sheet, copper sheet, or a resin plate of, for instance, a phenolic resin, an acrylic resin, an epoxy resin or the like. The adhesive layer is formed out of, for instance, an acrylic adhesive agent comprising an acrylate copolymer, an elastomeric adhesive agent comprising natural rubber, or an urethane adhesive agent comprising an urethane resin, but may be formed using ordinary adhesive agents. The adhesive layer may be formed as a two-side adhesive tape having the aforementioned adhesive layers. The release paper is composed of, for instance, half-bleached, high-quality or glassine paper that has formed thereon, on the side of release with an adhesive layer, a filling layer of polyethylene, polyvinyl alcohol or a clay coated material, and further has a release layer made of a silicone resin on the filling layer.

According to the present invention, a throating that enables temporary affixing and facilitates construction work can be provided.

DESCRIPTION OF THE PREFERRED EMBODIMENTS

The present invention will be explained in detail below with reference to accompanying diagrams.

Figure 1:
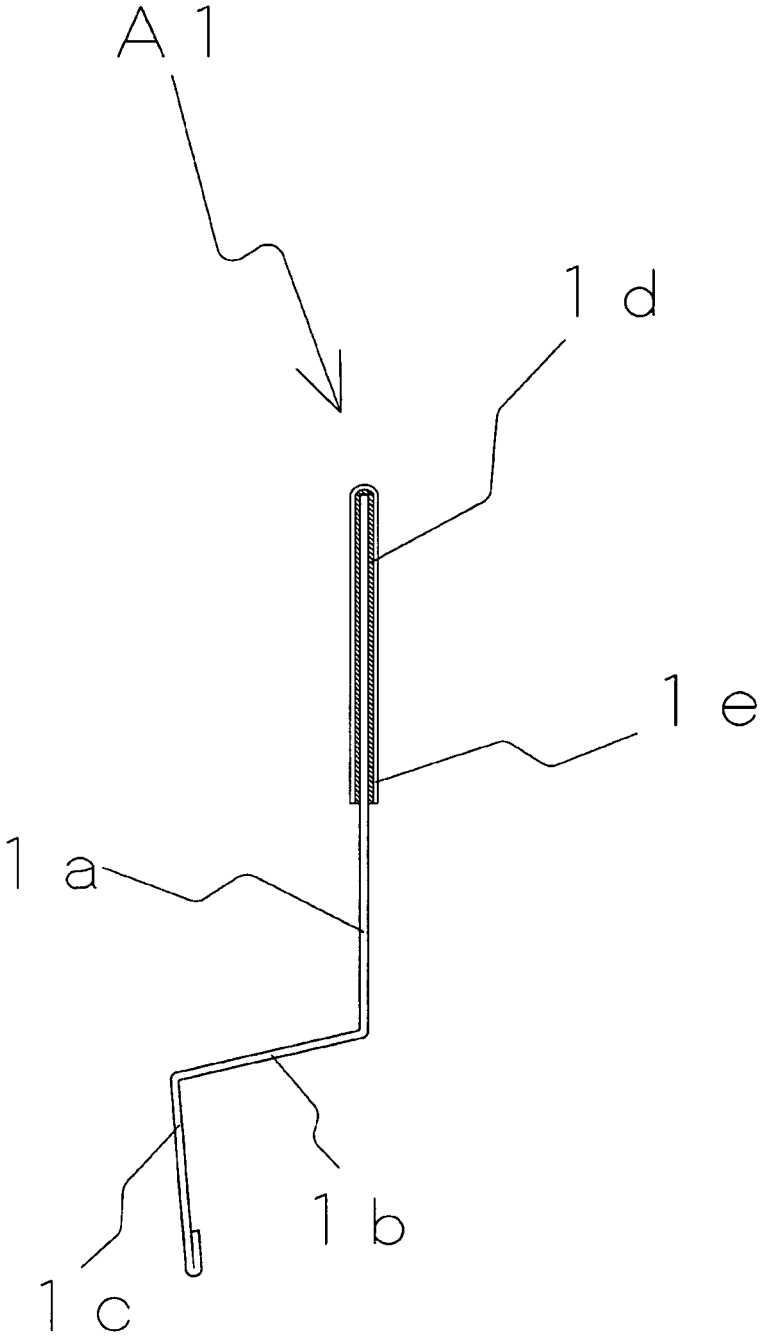
FIG. 1 is a right side-view diagram of an embodiment of a throating according to the present invention.

FIG. 1 is a right side-view diagram of an embodiment of a throating according to the present invention.

In a throating A1 illustrated in FIG. 1, which is manufactured by folding one Galvalume steel sheet, there are contiguously formed a rear plate part 1*a* fixed to a building frame, a throating plate part 1*b* bent obliquely downward and frontward at a lower end of the rear plate part 1*a*, and a front plate part 1*c* bent downward from the front end of the throating plate part 1*b*. More specifically, the rear plate part 1*a* is a flat plate part. The throating plate part 1*b* extends obliquely downward and frontward from the lower end of the rear plate part 1*a*. The front plate part 1*c* extends downward from the front end of the throating plate part 1*b*. On the front face, the top end portion and the rear face of the rear plate part 1*a*, an adhesive layer 1*d*, comprising an acrylic adhesive agent, is provided extending in the lengthwise direction, from the front face to the rear face of the rear plate part 1*a*, and the surface of the adhesive layer 1*d* is covered by one sheet of a release paper 1*e*. The release paper 1*e* has a release layer, comprising a silicone resin, at the contact surface with the adhesive layer 1*d*. The release paper 1*e* can thus be peeled off easily, and the adhesive layer 1*d* has adhesive performance once the release paper 1*e* has been peeled away. The release paper 1*e* extends, in the lengthwise direction, from the front face toward the rear face of the rear plate part 1*a*.

Therefore, the top end portion of the rear plate part 1*a* is covered by the adhesive layer 1*d* and the release paper 1*e*. This allows preventing the top end portion from damaging other materials, or from injuring personnel, during transport.

Figure 2:
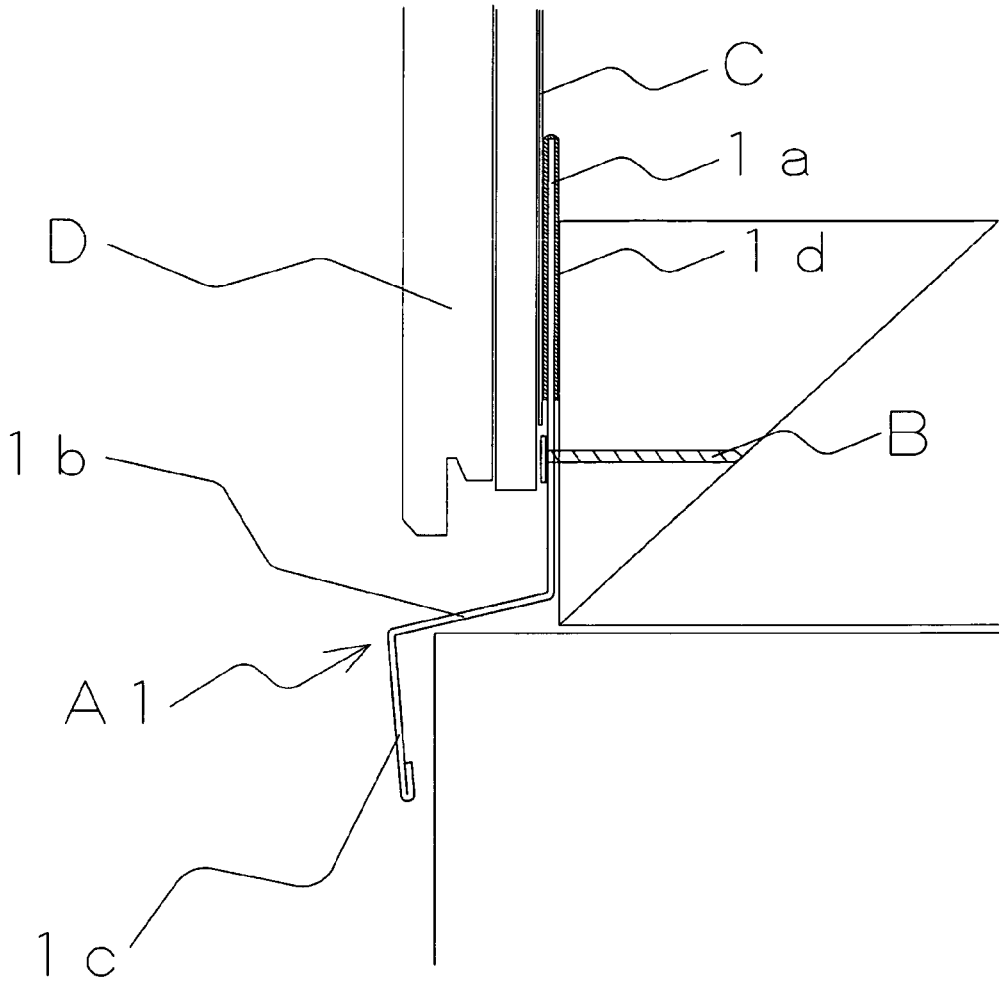
FIG. 2 is a cross-sectional diagram illustrating a construction state at a foundation sill of a building formed using the throating illustrated in FIG. 1.

FIG. 2 is a cross-sectional diagram illustrating a construction state at a foundation sill of a building formed using the throating illustrated in FIG. 1.

In FIG. 2, the throating A1 illustrated in FIG. 1 is fixed, by way of a nail B, at a position such that the rear face of the rear plate part 1*a* abuts a building frame, the throating plate part 1*b* and the front plate part 1*c* stand below an siding board D, and the front plate part 1*c* stands frontward of the building frame of the building. In this construction structure, the throating A1 is fixed to the building frame of the building through driving of the nail B into the rear plate part 1*a* of the throating A1. However, thanks to the adhesive layer 1*d* that is provided on the rear face of the rear plate part 1*a* of the throating A1, the throating A1 can be temporarily affixed, even before driving of the nail B, by peeling the release paper 1*e* off and then causing the throating A1 to abut the building frame of the building. Accordingly, the throating boasts good workability, in that the affixing operation can be easily accomplished by a single operator. The nail B can be driven after checking of the fixing position upon temporary affixing.

In this construction structure, the throating A1 is fixed to the building frame of the building, and thereafter a moisture-permeable waterproof sheet C is fixed to the front face of the rear plate part 1*a* of the throating A1. The throating A1 has the adhesive layer 1*d* on the front face of the rear plate part 1*a*, and hence the moisture-permeable waterproof sheet C can be fixed reliably by way of the adhesive layer 1*d*.

Further, the top end portion of the rear plate part 1*a* is covered by the adhesive layer 1*d*, and hence the top end portion can be prevented thereby from injuring personnel during construction work.

Accordingly, the throating A1 illustrated in FIG. 1 has good workability in terms of enabling temporary affixing and facilitating construction work.

Figure 3:
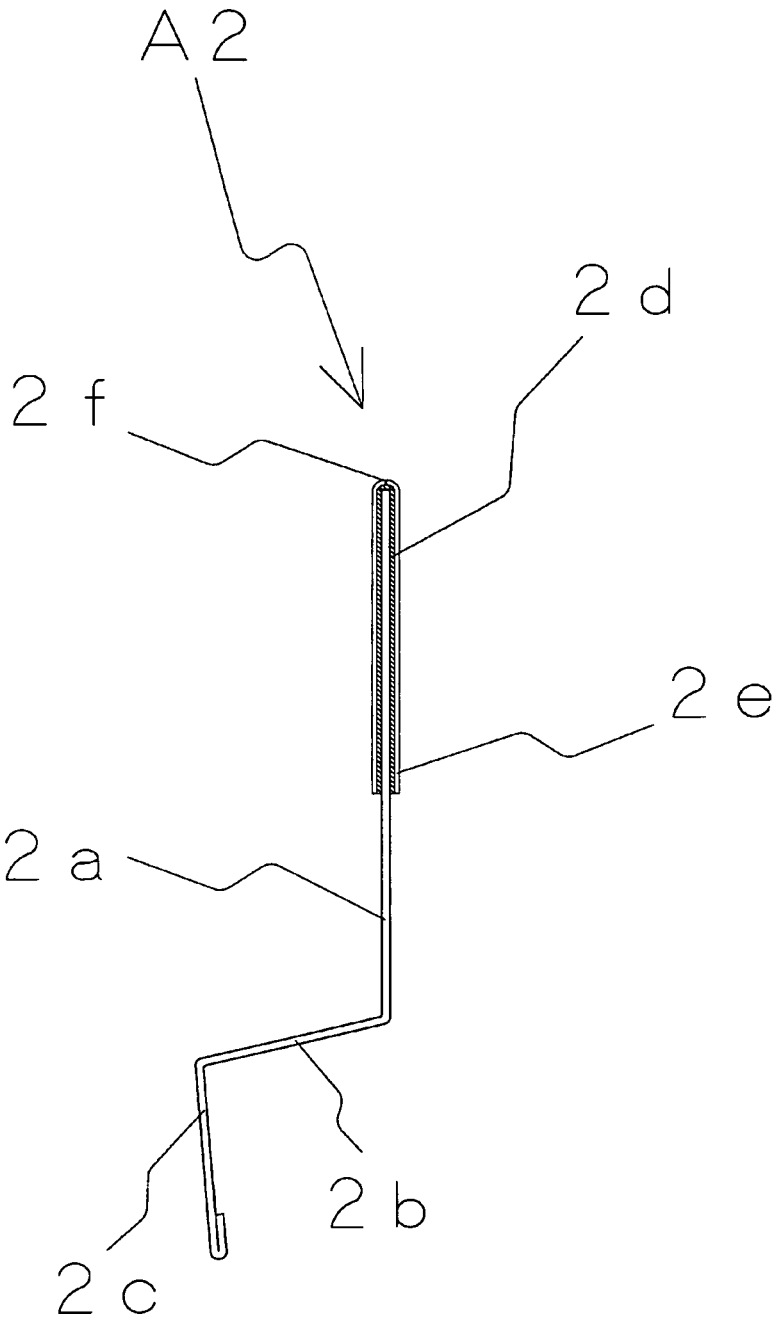
FIG. 3 is a right side-view diagram of another embodiment of a throating according to the present invention.

FIG. 3 is a right side-view diagram of another embodiment of a throating according to the present invention.

Similarly to the throating A1 illustrated in FIG. 1, in a throating A2 illustrated in FIG. 3, which is manufactured by folding one Galvalume steel sheet, there are contiguously formed a rear plate part 2*a*, a throating plate part 2*b* and a front plate part 2*c*. An adhesive layer 2*d*, comprising an acrylic adhesive agent, is provided from the front face toward the rear face of the rear plate part 2*a*, and the surface of the adhesive layer 2*d* is covered by one sheet of a release paper 2*e*. However, the throating A2 differs from the throating A1 in that the throating A2 has a cutting line in the release paper. In the throating A2 as well, the release paper 2*e* extends, in the lengthwise direction, from the front face toward the rear face of the rear plate part 2*a*, but herein a cutting line 2*f* extends, in the lengthwise direction of the rear plate part 2*a*, at the portion where the release paper 2*e* covers the top end portion of the rear plate part 2*a*. The release paper on the front face of the rear plate part 2*a*, and the release paper on the rear face of the rear plate part 2*a* can be peeled off independently, with the cutting line 2*f* as a boundary.

As a result, the throating A2 illustrated in FIG. 3 can be temporarily affixed, and then fixed to a building frame, while the adhesive layer 2*d* on the front face of the rear plate part 2*a* is still covered by the release paper 2*e*, by peeling off only the release paper 2*e* that covers the rear face of the rear plate part 2*a*. Consequently, there can be reliably prevented impairment of the adhesiveness of the adhesive layer 2*d* on the front face of the rear plate part 2*a*, due to contamination, during the operations of temporary affixing, and fixing, of the throating A2. Once the throating A2 has been fitted to the foundation sill of the building the release paper 2*e* on the front face of the rear plate part 2*a* is peeled off, and a moisture-permeable waterproof sheet is fixed to the adhesive layer 2*d* on the front face of the rear plate part 2*a*. As a result, the state of the throating A2 fitted to the foundation sill of the building, as in FIG. 2, is identical to that of the throating A1 illustrated in FIG. 1.

Accordingly, the throating A2 illustrated in FIG. 3 has good workability in terms of enabling temporary affixing and facilitating construction work.

Figure 4:
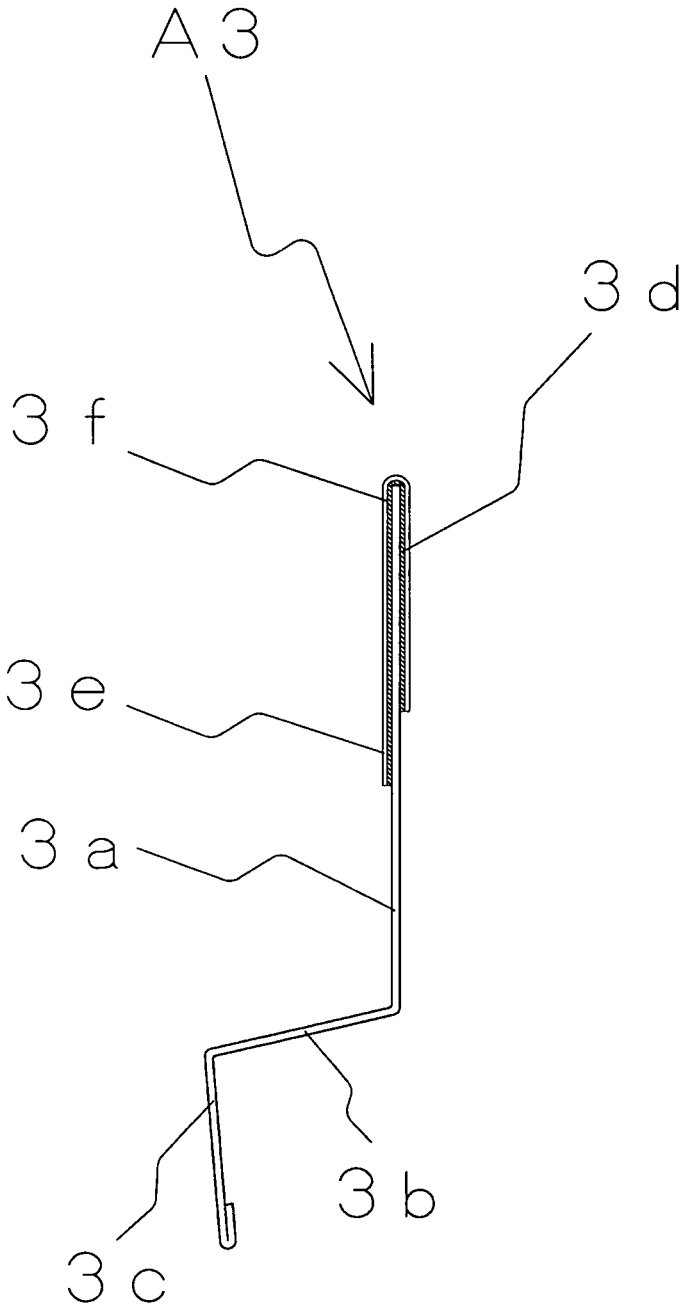
FIG. 4 is a right side-view diagram of yet another embodiment of a throating according to the present invention.

FIG. 4 is a right side-view diagram of another embodiment of a throating according to the present invention.

Similarly to the throating A2 illustrated in FIG. 3, in a throating A3 illustrated in FIG. 4, which is manufactured by folding one Galvalume steel sheet, there are contiguously formed a rear plate part 3*a*, a throating plate part 3*b* and a front plate part 3*c*. An adhesive layer 3*d*, comprising an acrylic adhesive agent, is provided from the front face toward the rear face of the rear plate part 3*a*, and the surface of the adhesive layer 3*d* is covered by one sheet of a release paper 3*e*. However, the throating A3 differs from the throating A2 in the shape of the adhesive layer and in the position of the cutting line of the release paper. In the throating A3, the length of the adhesive layer on the front face of the rear plate part 3*a* is different from the length of the adhesive layer on the rear face of the rear plate part 3*a*. Also, the cutting line 3*f* of the release paper 3*e* extends, in the lengthwise direction of the rear plate part 3*a*, at a portion covering the front face of the rear plate part 3*a*.

However, the throating A3 illustrated in FIG. 4 can be fitted in the same way as the throating A2 illustrated in FIG. 3, and can elicit the same effects as the throating A2.

Figure 5:
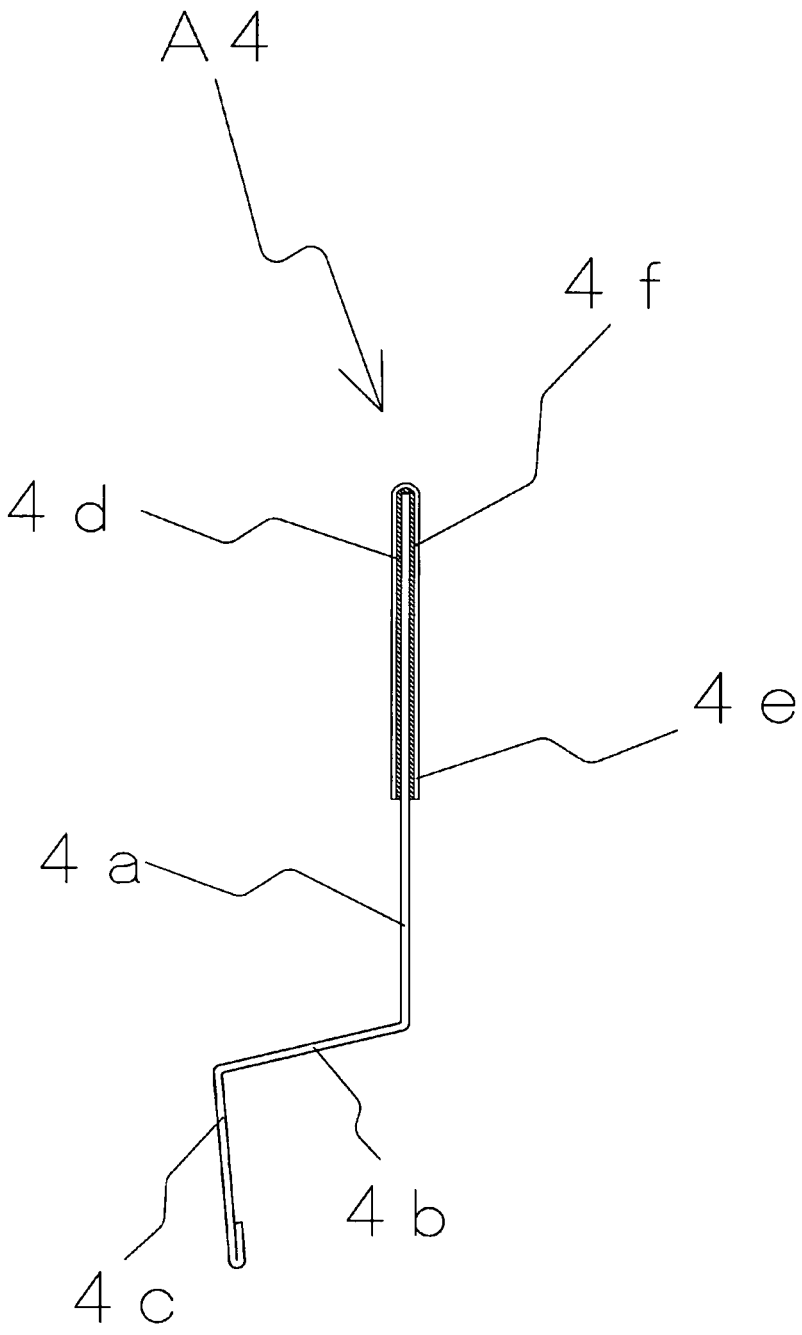
FIG. 5 is a right side-view diagram of yet another embodiment of a throating according to the present invention.

FIG. 5 is a right side-view diagram of yet another embodiment of a throating according to the present invention.

Similarly to the throating A2 illustrated in FIG. 3, in a throating A4 illustrated in FIG. 5, which is manufactured by folding one Galvalume steel sheet, there are contiguously formed a rear plate part 4*a*, a throating plate part 4*b* and a front plate part 4*c*. An adhesive layer 4*d*, comprising an acrylic adhesive agent, is provided from the front face toward the rear face of the rear plate part 4*a*, and the surface of the adhesive layer 4*d* is covered by one sheet of a release paper 4*e*. However, the throating A4 differs from the throating A2 in the position of a cutting line of the release paper. In the throating A4, a cutting line 4*f* of the release paper 4*e* extends, in the lengthwise direction of the rear plate part 4*a*, at a portion covering the rear face of the rear plate part 4*a*.

However, the throating A4 illustrated in FIG. 5 can be fitted in the same way as the throating A2 illustrated in FIG. 3, and can elicit the same effects as the throating A2.

Figure 6:
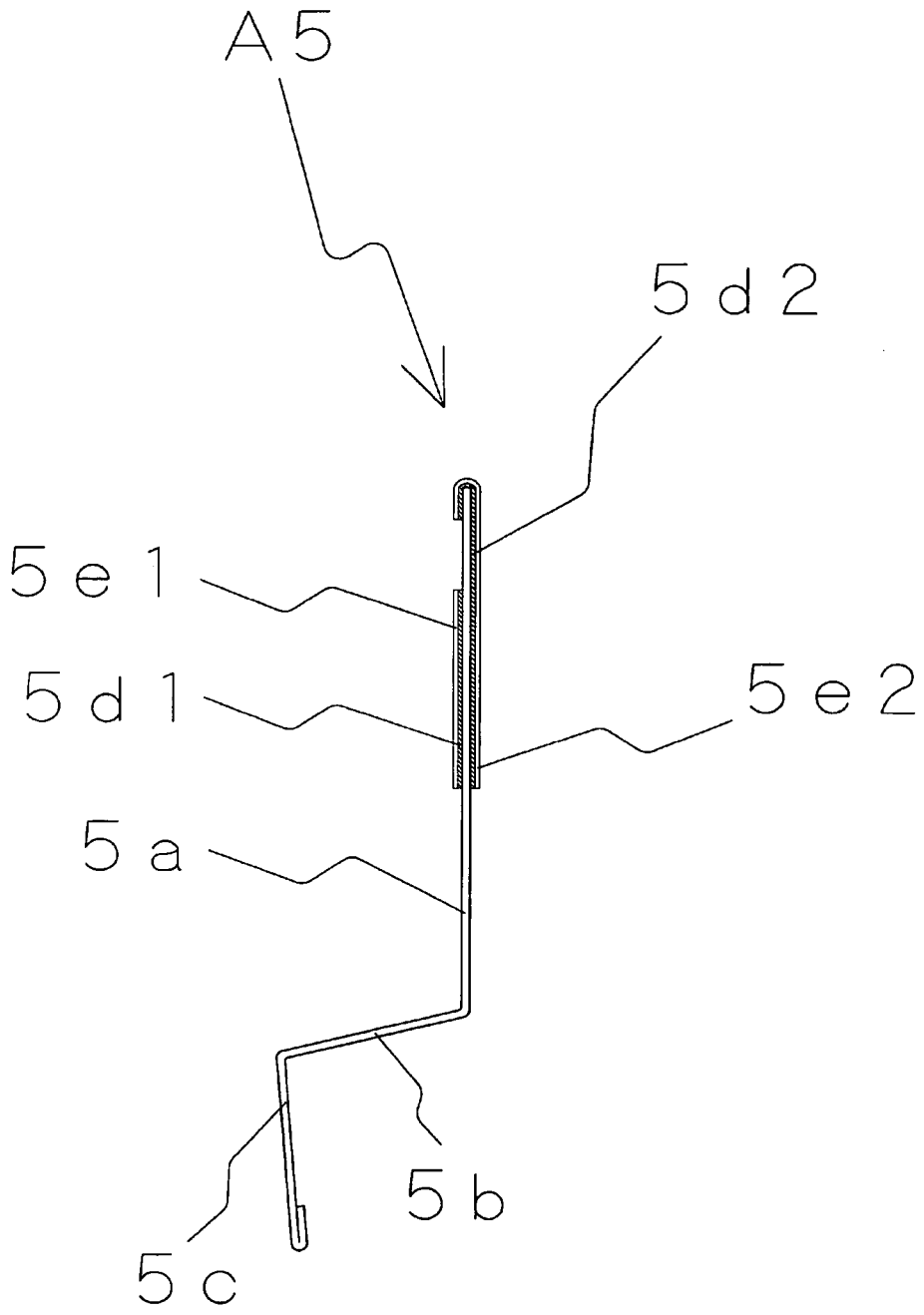
FIG. 6 is a right side-view diagram of yet another embodiment of a throating according to the present invention.

FIG. 6 is a right side-view diagram of yet another embodiment of a throating according to the present invention.

Similarly to the throating A1 illustrated in FIG. 1, in a throating A5 illustrated in FIG. 6, which is manufactured by folding one Galvalume steel sheet, there are contiguously formed a rear plate part 5*a*, a throating plate part 5*b* and a front plate part 5*c*. An adhesive layer, comprising an acrylic adhesive agent, is provided on the rear face, the top end portion and the front face of the rear plate part 5*a*. The surface of the adhesive layer is covered by a release paper. In the throating A5, however, the shape of the release paper and the adhesive layer are different from those of the throating A1. In the throating A5, the adhesive layer comprises an adhesive layer 5*d*1 extending in the lengthwise direction of the rear plate part 5*a*, on the front face of the rear plate part 5*a*, and a adhesive layer 5*d*2 extending in the lengthwise direction of the rear plate part 5*a*, and provided from the front face toward the rear face of the rear plate part 5*a*. The adhesive layer 5*d*1 and the adhesive layer 5*d*2 are not connected to each other. Accordingly, the release paper as well comprises a release paper 5*e*1 that covers the surface of the adhesive layer 5*d*1 and a release paper 5*e*2 that covers the surface of the adhesive layer 5*d*2, such that the release paper 5*e*1 and the release paper 5*e*2 are not connected to each other. The release paper 5*e*1 and the release paper 5*e*2 can thus be peeled off individually.

Nevertheless, the throating A5 illustrated in FIG. 6 can be fitted in the same way as the throating Al illustrated in FIG. 1, and can elicit the same effects as the throating A1. Since the release paper 5*e*1 and the release paper 5*e*2 can be peeled off individually, there can be elicited an effect identical to that of the throating A2 illustrated in FIG. 3.

Figure 7:
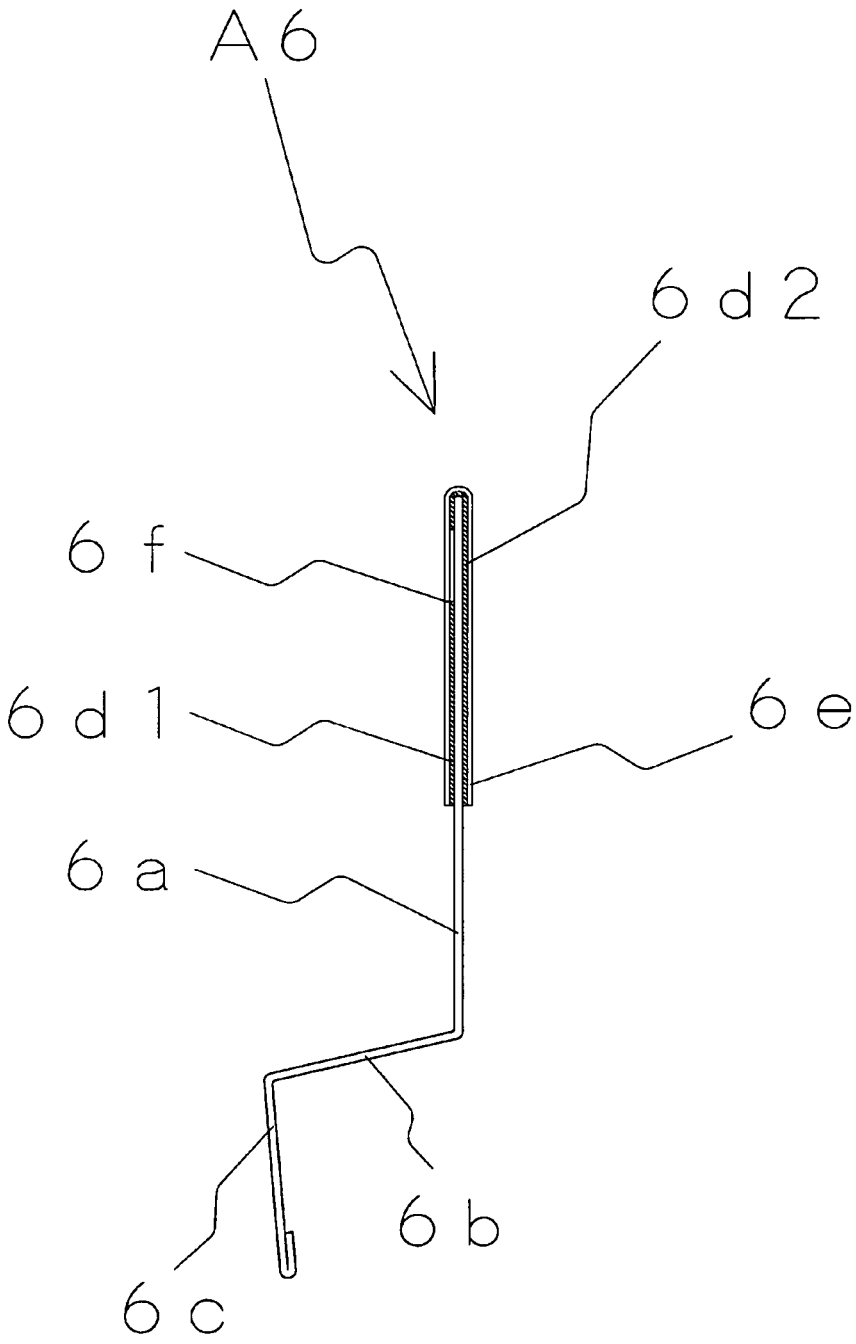
FIG. 7 is a right side-view diagram of yet another embodiment of a throating according to the present invention.

FIG. 7 is aright side-view diagram of yet another embodiment of a throating according to the present invention.

Similarly to the throating A5 illustrated in FIG. 6, in a throating A6 illustrated in FIG. 7, which is manufactured by folding one Galvalume steel sheet, there are contiguously formed a rear plate part 6*a*, a throating plate part 6*b* and a front plate part 6*c*. An adhesive layer 6*d*1, comprising an acrylic adhesive agent and extending in the lengthwise direction of the rear plate part 6*a*, is provided on the front face of the rear plate part 6*a*, an adhesive layer 6*d*2 comprising an acrylic adhesive agent and extending in the lengthwise direction of the rear plate part 6*a* is provided from the front face toward the rear face of the rear plate part 6*a*. The surfaces of the adhesive layer 6*d*1 and the adhesive layer 6*d*2 are covered by a release paper. The throating A6 differs from the throating A5 in the shape of the release paper and in having a cutting line in the release paper. In the throating A6, the adhesive layer 6*d*1 and the adhesive layer 6*d*2 are covered by one sheet of a release paper 6*e*, and a cutting line 6*f* extends, in the lengthwise direction of the rear plate part 6*a*, at a portion where the release paper 6*e* covers the front face of the rear plate part 6*a*.

Nevertheless, the throating A6 illustrated in FIG. 7 can be fitted in the same way as the throating A5 illustrated in FIG. 6, and can elicit the same effects as the throating A5.

Figure 8:
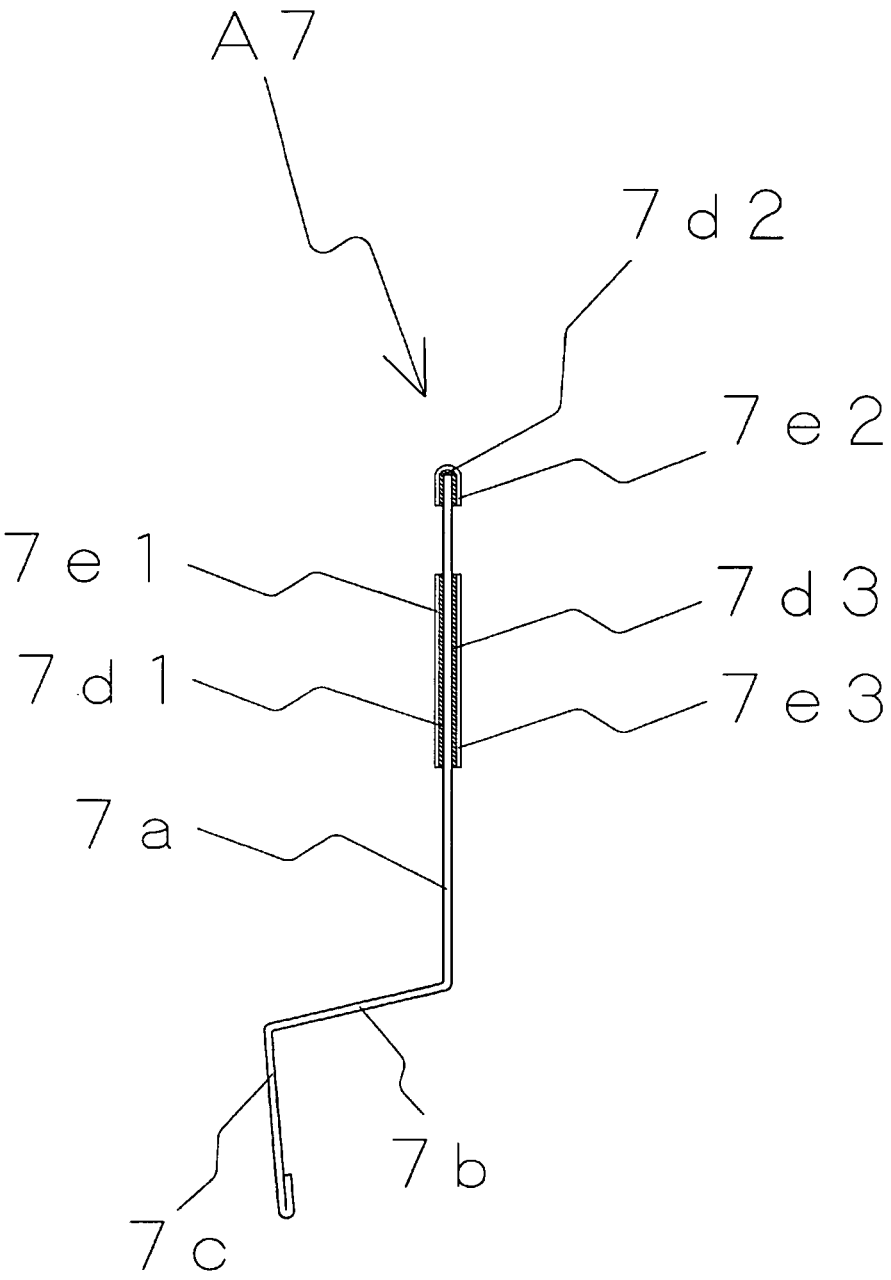
FIG. 8 is a right side-view diagram of yet another embodiment of a throating according to the present invention.

FIG. 8 is a right side-view diagram of yet another embodiment of a throating according to the present invention.

Similarly to the throating A1 illustrated in FIG. 1, in a throating A7 illustrated in FIG. 8, which is manufactured by folding one Galvalume steel sheet, there are contiguously formed a rear plate part 7*a*, a throating plate part 7*b* and a front plate part 7*c*. An adhesive layer, comprising an acrylic adhesive agent, is provided on the rear face, the top end portion and the front face of the rear plate part 7*a*. The surface of the adhesive layer is covered by a release paper. In the throating A7, however, the shape of the release paper and the adhesive layer are different from those of the throating A1. In the throating A7, the adhesive layer comprises an adhesive layer 7*d*1 extending in the lengthwise direction of the rear plate part 7*a*, on the front face of the rear plate part 7*a*, an adhesive layer 7*d*2 extending in the lengthwise direction of the rear plate part 7*a*, and provided from the front face toward the rear face of the rear plate part 7*a*, and a adhesive layer 7*d*3 extending in the lengthwise direction of the rear plate part 7*a*, on the rear face of the rear plate part 7*a*. The adhesive layer 7*d*1, the adhesive layer 7*d*2 and the adhesive layer 7*d*3 are not connected to each other. Accordingly, a release paper as well comprises a release paper 7*e*1 that covers the surface of the adhesive layer 7*d*1, a release paper 7*e*2 that covers the surface of the adhesive layer 7*d*2 and a release paper 7*e*3 that covers the surface of the adhesive layer 7*d*3. The release paper 7*e*1, the release paper 7*e*2 and the release paper 7*e*3 are not connected to each other. The release paper 7*e*1, the release paper 7*e*2 and the release paper 7*e*3 can thus be peeled off individually.

Nevertheless, the throating A7 illustrated in FIG. 8 can be fitted in the same way as the throating A1 illustrated in FIG. 1, and can elicit the same effects as the throating A1. Since the release papers can be peeled off individually, there can be elicited an effect identical to that of the throating A2 illustrated in FIG. 3.

Figure 9:
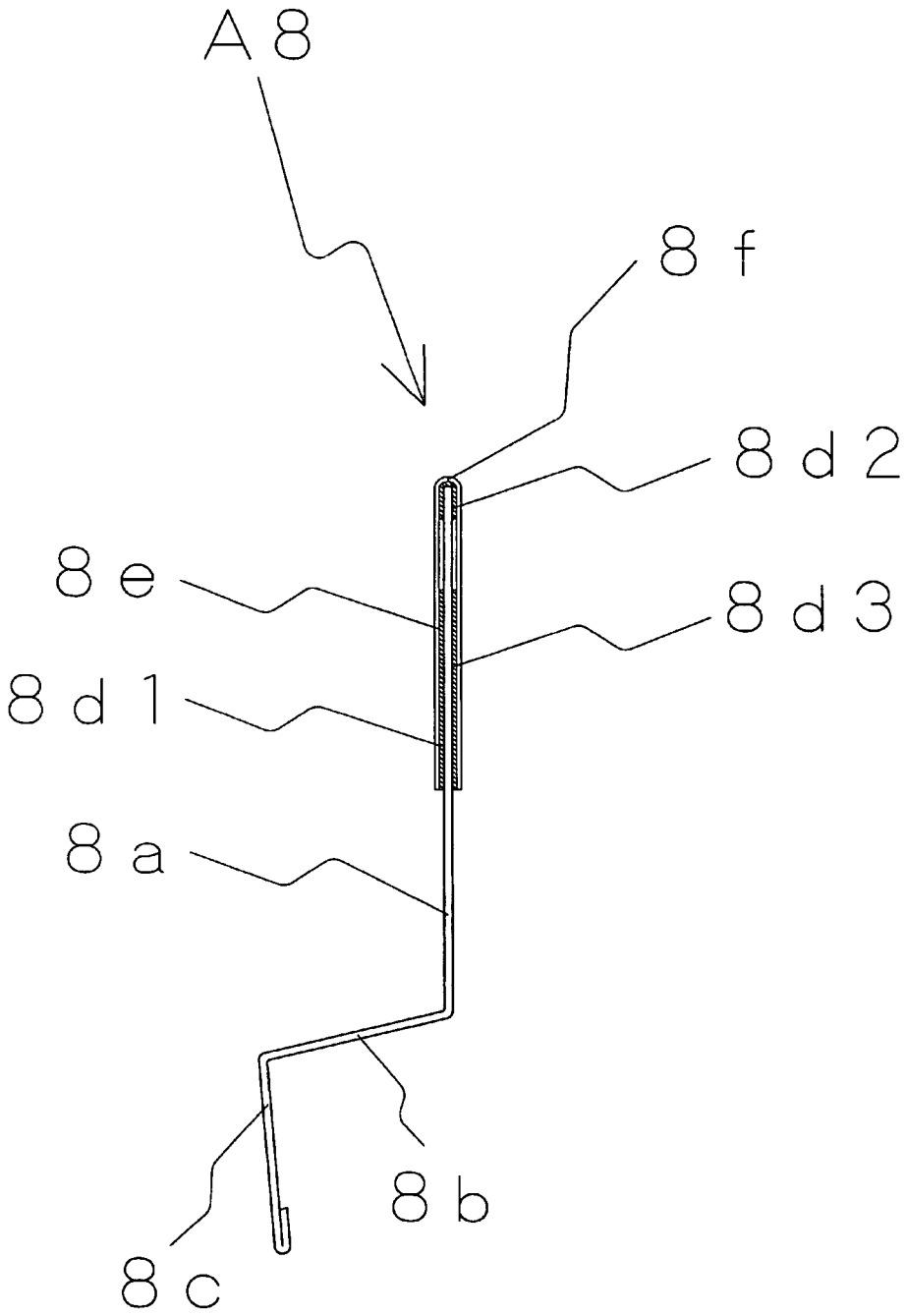
FIG. 9 is a right side-view diagram of yet another embodiment of a throating according to the present invention.

FIG. 9 is a right side-view diagram of yet another embodiment of a throating according to the present invention.

Similarly to the throating A7 illustrated in FIG. 8, in a throating A8 illustrated in FIG. 9, which is manufactured by folding one Galvalume steel sheet, there are contiguously formed a rear plate part 8*a*, a throating plate part 8*b* and a front plate part 8*c*. An adhesive layer 8*d*1, comprising an acrylic adhesive agent and extending in the lengthwise direction of the rear plate part 8*a*, is provided on the front face of the rear plate part 8*a*, an adhesive layer 8*d*2 comprising an acrylic adhesive agent and extending in the lengthwise direction of the rear plate part 8*a* is provided from the front face toward the rear face of the rear plate part 8*a*, and an adhesive layer 8*d*3 comprising an acrylic adhesive agent and extending in the lengthwise direction of the rear plate part 8*a* is provided on the rear face of the rear plate part 8*a*, such that the adhesive layer 8*d*1, the adhesive layer 8*d*2 and the adhesive layer 8*d*3 are not connected to each other. The surfaces of the adhesive layer 8*d*1, the adhesive layer 8*d*2 and the adhesive layer 8*d*3 are covered by a release paper. The throating A8, however, differs from the throating A7 in the form of the release paper and in having a cutting line in the release paper. In the throating A8, the adhesive layer 8*d*1, the adhesive layer 8*d*2 and the adhesive layer 8*d*3 are covered by one sheet of a release paper 8*e*, and a cutting line 8*f* extends, in the lengthwise direction of the rear plate part 8*a*, at a portion where the release paper 8*e* covers the top end portion of the rear plate part 8*a*.

Nevertheless, the throating A8 illustrated in FIG. 9 can be fitted in the same way as the throating A7 illustrated in FIG. 8, and can elicit the same effects as the throating A7.

Figure 10:
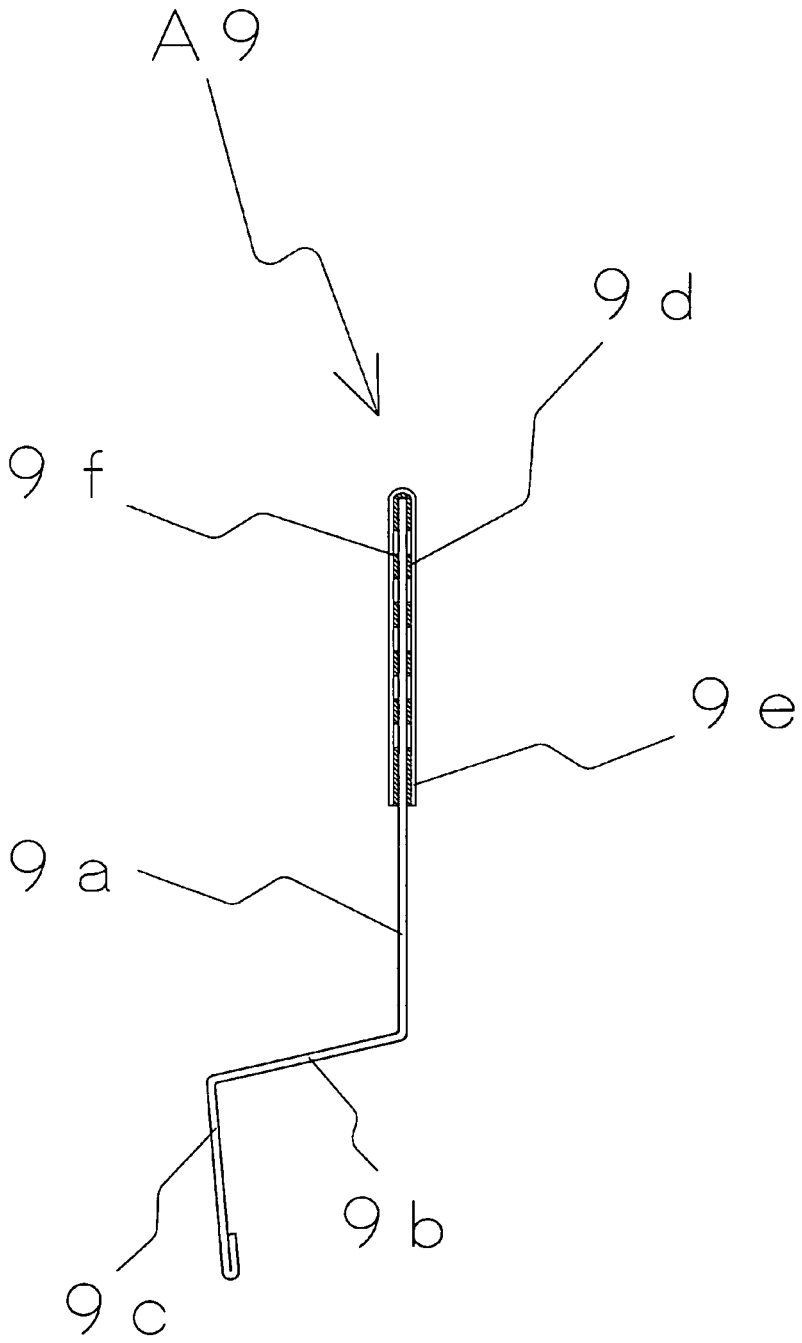
FIG. 10 is a right side-view diagram of yet another embodiment of a throating according to the present invention.

FIG. 10 is aright side-view diagram of yet another embodiment of a throating according to the present invention.

Similarly to the throating A2 illustrated in FIG. 3, in a throating A9 illustrated in FIG. 10, which is manufactured by folding one Galvalume steel sheet, there are contiguously formed a rear plate part 9*a*, a throating plate part 9*b* and a front plate part 9*c*. An adhesive layer, comprising an acrylic adhesive agent, is provided on the rear face, the top end portion and the front face of the rear plate part 9*a*. The surface of the adhesive layer is covered by a release paper. However, the adhesive layer and the position of the cutting line of the release paper in the throating A9 are different from those of the throating A2. In the throating A9, an adhesive layer 9*d* extending in the lengthwise direction of the rear plate part 9*a* is provided in the form of a plurality of layers from the front face toward the rear face of the rear plate part 9*a*, such that the adhesive layers are not connected to each other. However, the entire surface of the adhesive layer 9*d* is covered by one sheet of a release paper 9*e*. A cutting line 9*f* extends, in the lengthwise direction of the rear plate part 9*a*, at a portion where the release paper 9*e* covers the front face of the rear plate part 9*a*.

Nevertheless, the throating A9 illustrated in FIG. 10 can be fitted in the same way as the throating A2 illustrated in FIG. 3, and can elicit the same effects as the throating A2.

Figure 11:
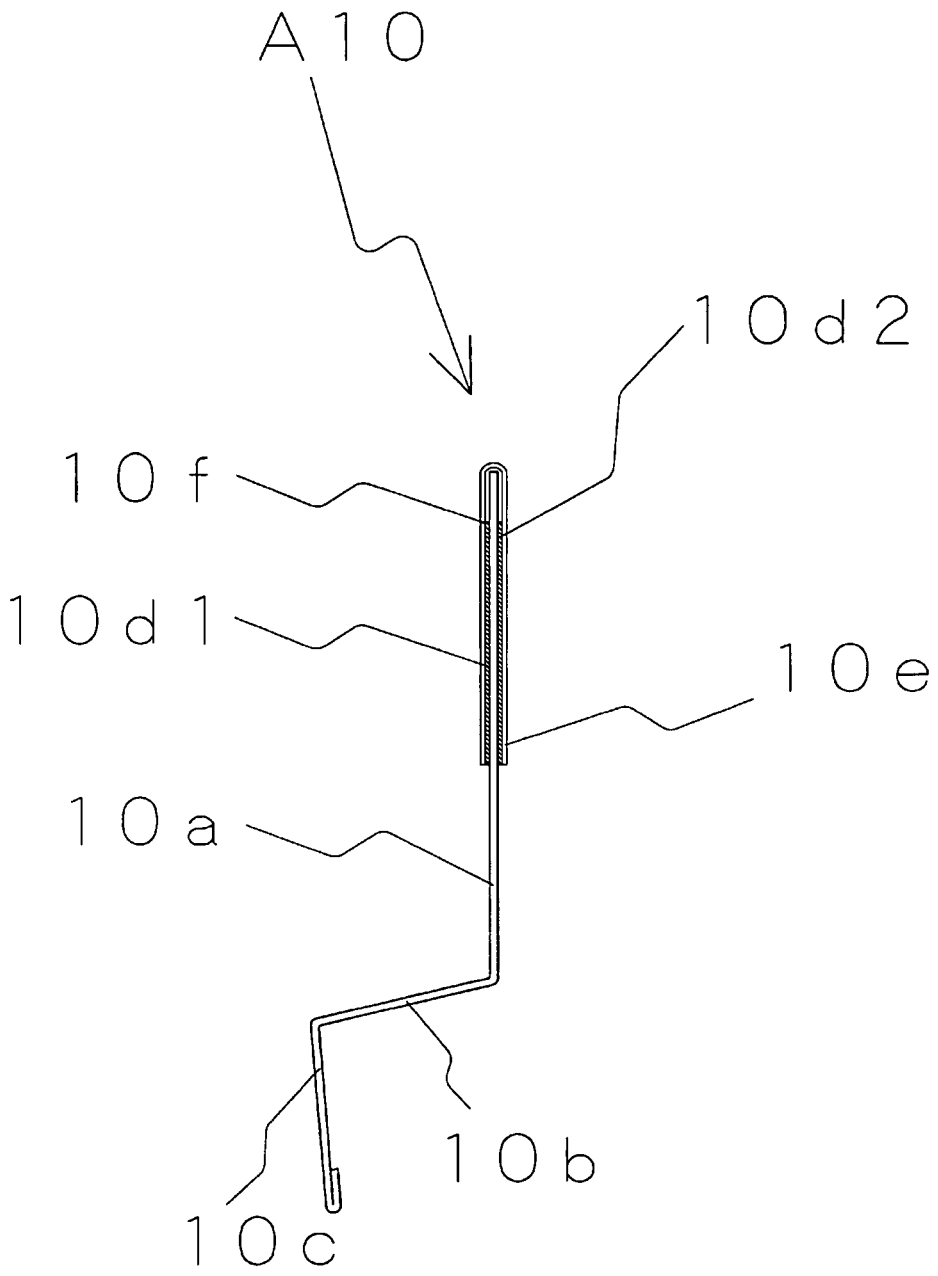
FIG. 11 is a right side-view diagram of yet another embodiment of a throating according to the present invention.

FIG. 11 is a right side-view diagram of yet another embodiment of a throating according to the present invention.

Similarly to the throating A2 illustrated in FIG. 3, in a throating A10 illustrated in FIG. 11, which is manufactured by folding one Galvalume steel sheet, there are contiguously formed a rear plate part 10*a*, a throating plate part 10*b* and a front plate part 10*c*. An adhesive layer, comprising an acrylic adhesive agent, is provided on the front face and the rear face of the rear plate part 10*a*, and the surface of the adhesive layer is covered by a release paper. However, the adhesive layer and the position of the cutting line of the release paper in the throating A10 are different from those of the throating A2. In the throating A10, an adhesive layer 10*d*1, extending in the lengthwise direction of the rear plate part 10*a*, is provided on the front face of the rear plate part 10*a*, and an adhesive layer 10*d*2, extending in the lengthwise direction of the rear plate part 10*a*, is provided on the rear face of the rear plate part 10*a*, such that the adhesive layer 10*d*1 and the adhesive layer 10*d*2 are not connected to each other. However, the surfaces of the adhesive layer 10*d*1 and the adhesive layer 10*d*2 are covered by one sheet of a release paper 10*e*. A cutting line 10*f* extends, in the lengthwise direction of the rear plate part 10*a*, at a portion where the release paper 10*e* covers the front face of the rear plate part 10*a*.

Nevertheless, the throating A10 illustrated in FIG. 11 can be fitted in the same way as the throating A2 illustrated in FIG. 3, and can elicit the same effects as the throating A2.

Figure 12:
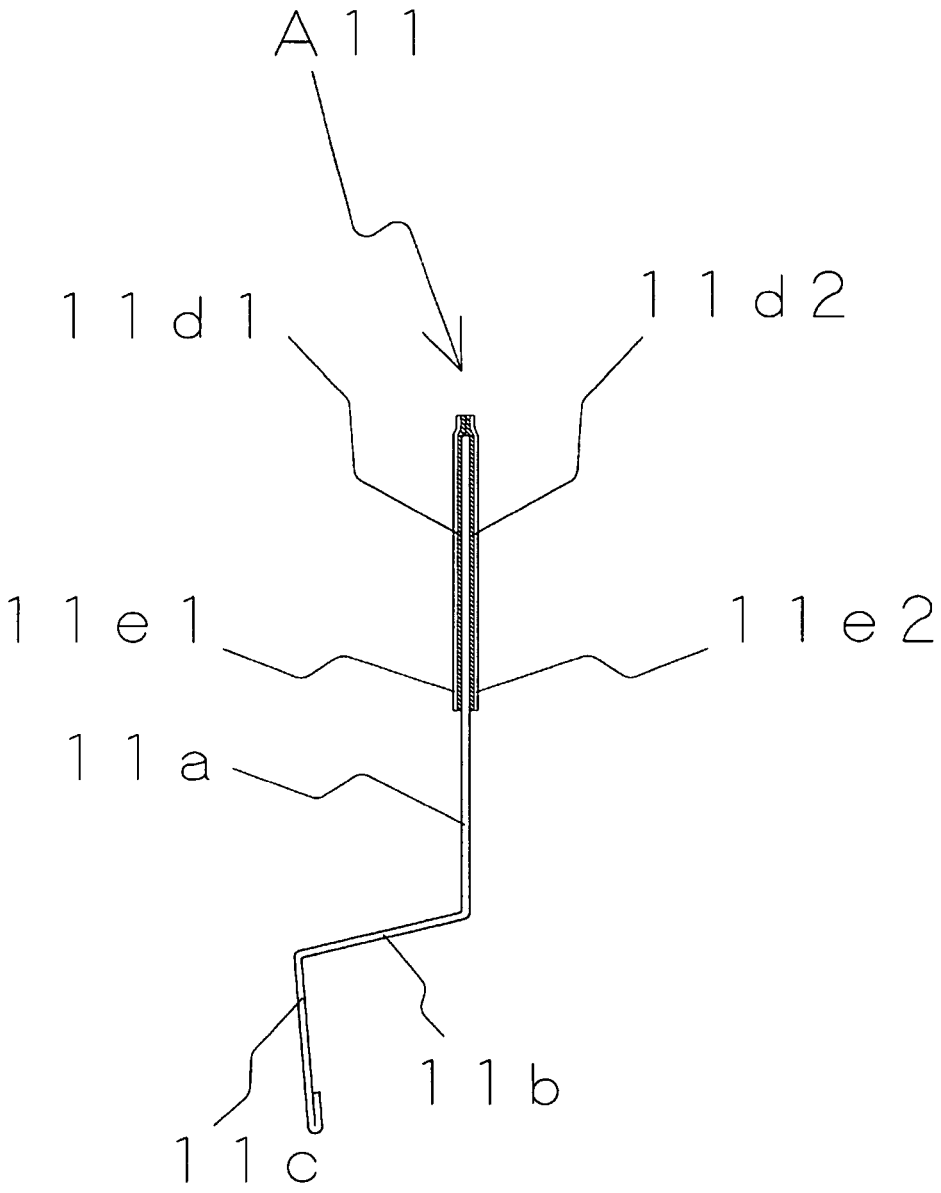
FIG. 12 is a right side-view diagram of yet another embodiment of a throating according to the present invention.

FIG. 12 is a right side-view diagram of yet another embodiment of a throating according to the present invention.

Similarly to the throating A1 illustrated in FIG. 1, in a throating All illustrated in FIG. 12, which is manufactured by folding one Galvalume steel sheet, there are contiguously formed a rear plate part 11*a*, a throating plate part 11*b* and a front plate part 11*c*. An adhesive layer, comprising an acrylic adhesive agent, is provided on the front face and the rear face of the rear plate part 11*a*, and the surface of the adhesive layer is covered by a release paper. In the throating A11, however, the shape of the release paper and the adhesive layer are different from those of the throating A1. In the throating A11, an adhesive layer 11*d*1, extending in the lengthwise direction of the rear plate part 11*a*, is provided on the front face of the rear plate part 11*a*, and an adhesive layer 11*d*2, extending in the lengthwise direction of the rear plate part 11*a*, is provided on the rear face of the rear plate part 11*a*. The adhesive layer 11*d*1 and the adhesive layer 11*d*2 extend, in the width direction, further up than the top end of the rear plate part 11*a*, such that the rear faces of the adhesive layer 11*d*1 and of the adhesive layer 11*d*2 are bonded to each other further up than the top end of the rear plate part 11*a*. The surface of the adhesive layer 11*d*1 is covered by a release paper 11*e*1, and the surface of the adhesive layer 11*d*2 is covered by a release paper 11*e*2. The release paper 11*e*1 and the release paper 11*e*2 are not connected to each other.

Nevertheless, the throating A11 illustrated in FIG. 12 can be fitted in the same way as the throating A1 illustrated in FIG. 1, and can elicit the same effects as the throating A1. Since the release paper 11*e*1 and the release paper 11*e*2 can be peeled off individually, there can be elicited an effect identical to that of the throating A2 illustrated in FIG. 3.

Embodiments of the present invention have been explained above, but the present invention is not limited thereto, and can accommodate various modifications without departing from the scope of the invention as set forth in the appended claims. For instance, the adhesive layer may be an elastomeric adhesive agent, the surface of the adhesive layer may have protrusions, or the adhesive layer may be arrayed in the form of protrusions. Also, the adhesive layer on the front face of the rear plate part may be provided above or below the center of the rear plate part, and nails be driven through the center of the rear plate part.

As explained above, the present invention provides a throating that enables temporary affixing and facilitates construction work.

What is claimed is:

1. A throating comprising:

a rear plate part that is fixed to a building frame;

a throating plate part bent obliquely downward and frontward at a lower end of the rear plate part; and a front plate part bent downward from a front end of the throating plate part, wherein the throating is formed of a cut metal, a top end portion of the rear plate part has a cut surface, a lower end of the front plate part is bent upward and folded, the throating has an adhesive layer on each of a front face and a rear face of the rear plate part, and a release paper is disposed on the rear plate part so that the release paper covers the surface of the adhesive layers and the top end portion of the rear plate part.

2. The throating according to claim 1, wherein the throating further has an adhesive layer on a top end portion of the rear plate part, the adhesive layers on the front face and the rear face of the rear plate part are not connected to the adhesive layer on the top end portion of the rear plate part, and the release paper covers the surface of the adhesive layers.

3. The throating according to claim 1, wherein the throating further has an adhesive layer on a top end portion of the rear plate part, the adhesive layer on the front face or the rear face of the rear plate part is not connected to the adhesive layer on the top end portion of the rear plate part, and the release paper covers the surface of the adhesive layers.

4. The throating according to claim 1, wherein the throating further has an adhesive layer on a top end portion of the rear plate part, and the adhesive layers on the front face, the rear face and the top end portion of the rear plate part are connected, the a release paper cover the surface of each of the adhesive layers.

5. The throating according to claim 1, wherein a cutting line extending in a lengthwise direction of the rear plate part is provided at a portion of the release paper positioned at the top end portion of the rear plate part.

6. The throating according to claim 1, wherein a cutting line extending in a lengthwise direction of the rear plate part is provided at a portion of the release paper positioned at the front face of the rear plate part.

7. The throating according to claim 1, wherein a cutting line extending in a lengthwise direction of the rear plate part is provided at a portion of the release paper positioned at the rear face of the rear plate part.

8. The throating according to any one of claims 1 to 4, wherein the adhesive layer on the front face of the rear plate part is applied on an upper portion of the front face and a lower portion of the front face is left blank without the adhesive layer and the release paper so that the rear plate part can be fixed to the building frame by a nail through the lower portion of the front face of the rear plate part.

9. A constructional structure comprising:

a siding board;

a building frame;

a water proof sheet; and a throating, wherein the throating comprises:

a rear plate part;

a throating plate part bent obliquely downward and frontward at a lower end of the rear plate part; and a front plate part bent downward from a front end of the throating plate part, wherein the throating is formed of a cut metal, a top end portion of the rear plate part has a cut surface, a lower end of the front plate part is bent upward and folded, and the throating has an adhesive layer on each of a front face and a rear face of the rear plate part, the rear plate part of the throating is located between the siding board and the building frame, the throating is disposed on the building frame so that the rear face of the rear plate part abuts the building frame, the throating plate part extends frontward of the building frame, and the throating plate part and the front plate part are located below the siding board, the adhesive layer on the rear face of the rear plate part of the throating is attached to the building frame and the rear plate part of the throating is fixed to the building frame by a nail, the water proof sheet is attached to the adhesive layer of the front face of the rear plate part of the throating so that the water proof sheet is disposed along a rear surface of the siding board.

10. The constructional structure according to claim 9, wherein the throating further has an adhesive layer on a top end portion of the rear plate part, and the adhesive layers on the front face and the rear face of the rear plate part are not connected to the adhesive layer on the top end portion of the rear plate part.

11. The constructional structure according to claim 9, wherein the throating further has an adhesive layer on a top end portion of the rear plate part, and the adhesive layer on the front face or the rear face of the rear plate part is not connected to the adhesive layer on the top end portion of the rear plate part.

12. The constructional structure according to claim 9, wherein the throating further has an adhesive layer on a top end portion of the rear plate part, and the adhesive layers on the front face, the rear face and the top end portion of the rear plate part are connected.

13. The constructional structure according to claim 9, wherein the adhesive layer on the front face of the rear plate part is applied on an upper portion of the front face and a lower portion of the front face is left blank without the adhesive layer, and the rear plate part is fixed to the building frame by the nail through the lower portion of the front face of the rear plate part.

* * * * *